US012370598B2

(12) United States Patent
Mohatta

(10) Patent No.: US 12,370,598 B2
(45) Date of Patent: Jul. 29, 2025

(54) APPARATUS TO CAST TUBES OF SLUGGISH MATERIAL AND A PROCESS THEREOF

(71) Applicant: Saurabh Alok Mohatta, Mumbai (IN)

(72) Inventor: Saurabh Alok Mohatta, Mumbai (IN)

( * ) Notice: Subject to any disclaimer, the term of this patent is extended or adjusted under 35 U.S.C. 154(b) by 0 days.

(21) Appl. No.: 18/886,411

(22) Filed: Sep. 16, 2024

(65) Prior Publication Data

US 2025/0001488 A1 Jan. 2, 2025

Related U.S. Application Data

(63) Continuation-in-part of application No. PCT/IB2023/058050, filed on Aug. 9, 2023.

(30) Foreign Application Priority Data

Dec. 7, 2022 (IN) ..... 202221070649

(51) Int. Cl.
*B22D 13/02* (2006.01)
*B22D 1/00* (2006.01)
*B22D 13/10* (2006.01)

(52) U.S. Cl.
CPC ..... *B22D 13/023* (2013.01); *B22D 1/00* (2013.01); *B22D 13/102* (2013.01); *B22D 13/107* (2013.01)

(58) Field of Classification Search
CPC .. B22D 13/023; B22D 13/102; B22D 13/107; B22D 13/02
See application file for complete search history.

(56) References Cited

U.S. PATENT DOCUMENTS 3,409,068 A 11/1968 Yearley et al.

FOREIGN PATENT DOCUMENTS

| | | | |
|---|---|---|---|
| JP | 2010234389 | A | 10/2010 |
| JP | 2013018029 | A | 1/2013 |
| RU | 2344019 | C1 | 1/2009 |

OTHER PUBLICATIONS https://web.archive.org/web/20210508081707/https://www.eplastics.com/shapes/acetal-delrin/tube (Year: 2021).*
International Search Report; WO2024/121630 A1; Nov. 30, 2023.

* cited by examiner

*Primary Examiner* — Keith Walker
*Assistant Examiner* — Steven S Ha
(74) *Attorney, Agent, or Firm* — Sand, Sebolt & Wernow Co., LPA

(57) ABSTRACT

The present disclosure relates to an apparatus to cast tubes of sluggish material and a process thereof. The apparatus comprises at least one cylindrical casting mold, heating means, at least one set of rollers, a driving member, at least one tank, a spray nozzle, at least one tundish, a reinforced snout, cooling means and a drive control unit. The mold is configured to receive the molten sluggish material therein. The rollers are configured to abut an operative outer surface of the casting mold. The driving member is configured to spin the casting mold in an operative configuration of the apparatus to cast the tube of a predetermined inner diameter (ID), outer diameter (OD) and a predetermined length. Since, the addition of fluidity enhancer increases the fluidity of the molten sluggish material inside the mold, advantageously the smaller diameter of the tubes are easily produced by this process.

17 Claims, 6 Drawing Sheets

APPARATUS TO CAST TUBES OF SLUGGISH MATERIAL AND A PROCESS THEREOF

REFERENCE TO RELATED APPLICATIONS

This application is a Continuation-in-Part of International Patent Application Serial No. PCT/IB2023/058050 entitled "AN APPARATUS TO CAST TUBES OF SLUGGISH MATERIAL AND A PROCESS THEREOF", filed on Aug. 9, 2023, which in turn claims the benefit of priority to Indian Patent Application Serial No. IN 202221070649, filed on Dec. 7, 2022.

TECHNICAL FIELD

The present disclosure generally relates to casting of tubes of sluggish material. In particular, the present invention relates to an apparatus for casting a tube of stainless steel and superalloys.

Definition

As used in the present disclosure, the following terms are generally intended to have the meaning as set forth below, except to the extent that the context in which they are used indicates otherwise.

SLUGGISH MATERIAL: The expression 'sluggish material' used in the context of this disclosure refers to material that is highly viscous in nature, and its flow velocity is comparatively low. Sluggish material such as stainless steel, super alloys, and other engineering materials, includes high density alloying elements, consisting of a combination of either Nickel, Chromium, Molybdenum, Tungsten, Cobalt or a combination thereof, along with other exotic alloying elements.

REFRACTORY COATING MATERIAL: The expression 'refractory coating material' used in the context of this disclosure refers to, but is not limited to, a material that is resistant to decomposition at high temperatures and is predominantly used in coatings and other applications for processing materials at an elevated temperature. The refractory coating material includes natural ores and various products which have certain high-temperature mechanical properties and good volume stability.

TUNDISH: The expression 'tundish' used in the context of this disclosure refers to, but is not limited to, a reservoir or a container with one or more holes at the bottom which is used to receive molten metal from a ladle and redirect it's flow in a desired direction while casting.

SILICA COATING: The expression 'silica coating' used in the context of this disclosure refers to, but is not limited to, a slurry formed by mixing Silica flour paste with water, and has a property to withstand high temperature and provides a barrier between the molten metal and the mold ID, so as to prevent fusion between the two. It also aids in extracting the pipe as it adheres to the surface of the pipe, during extraction, thus functioning as a slip plane during the extraction of the pipe.

SUPERALLOYS: The expression 'super alloys" used in the context of this disclosure refers to, but is not limited to, a group of materials or alloys such as nickel-based, iron-based, iron nickel-based, or cobalt-based alloy to which multiple alloying elements are added. They are engineered to exhibit a combination of high mechanical strength, resistance to thermal creep deformation, good surface stability, and resistance to oxidation or corrosion at elevated temperatures greater than 537.778° C. (1000° F.).

SYNTHETIC SLAG: The expression 'synthetic slag' used in the context of this disclosure refers to, but is not limited to, a mixture formed by mixing several individual oxides which is used during steelmaking in the furnace or ladle for metal refinement.

BACKGROUND ART

The background information herein below relates to the present disclosure but is not necessarily prior art.

Typically, Horizontal Centrifugal casting is used for casting of tubes. However, the length of the tube that can be cast is limited to a practicable length. Tubes, produced by the Centrifugal or Spun Casting process, generally have an outside diameter (OD) greater than 60 mm (2.362 inches). In some cases, they have an OD of 60 mm (2.362 inches) with an inside diameter (ID) of around 25-30 mm (0.984 inches-1.181 inches). However, the casting of smaller size tubes with OD's ranging from 36 mm-45 mm (1.417 inches-1.772 inches) and/or ID's ranging from 12 mm-22 mm (0.472 inches-0.866 inches) are difficult to produce consistently, especially over a length of one meter (39.37 inches) or more, and even more so with materials or alloys that have sluggish flow characteristics. Additionally, it is difficult to evenly coat the ID of the casting mold with a refractory coating material by using conventional methods and further even more difficult to feed hot sluggish molten metal into the casting mold through a small aperture, before it freezes up.

In addition, other conventional methods of manufacturing tubes, such as solid drawing for thin-walled tubing, or welding and drawing, involve numerous process steps and are expensive. Further, the conventional casting processes of tubes such as sand casting or investment casting, leads to defects such as entrapment of gases and non-metallic impurities and are highly labor-intensive. Especially the use of sand as a raw material for creating molds can cause defects such as sand inclusions in the final product. Furthermore, there is a possibility of non-metallic impurities inclusion within the molten metal during the traditional casting of tubes. These defects can result in void creation, which impair the mechanical properties, surface finish, and dimensional accuracy of the cast tube.

In case of tube manufacturing, of hard, strong or tough stainless steel and superalloys by a rolling operation, the rollers need to be of very hard material and the entire system needs to be extremely sturdy to withstand the load of compression, during manufacturing. In addition, materials such as Cobalt Chrome Alloy 6, are inherently very hard, and others like M35-1, Cu5MCuC, and CY40, are known for their work-hardening nature. Manufacturing tubes of these materials through forging or rolling can be extremely expensive. Additionally, producing them in a hollow condition, particularly for small inner diameters (IDs), require starting with solid forms and then boring out the ID. The process is prohibitively expensive and time consuming for tubes having dimensions spanning 1.5 to 2 meters (59.055 inches to 78.740 inches) in length.

Furthermore, the rolling or forging operation requires heavy machinery equipment and considerably large floor space, which in-turn, would add-up to large investment and labor cost, making it unviable for niche requirements of stainless steel and superalloys alloys. In addition, components or tubes manufactured by other processes, such as forging and rolling, can lead to the formation of cracks as the materials are subjected to a high amount of mechanical stress in the solid state. Materials like carbon and sulfur, that are desirable for certain applications further exacerbate this issue, as they are known to cause cracks in forged and rolled components, and hence cannot be added to the desired extent.

Still further, tubes cast using traditional casting methods are susceptible to leaks under high pressure of greater than 4.5 bar. Therefore, tubes produced by the traditional casting methods are not suitable for applications requiring a leak-proof operation under pressure.

Thus, there is felt a need for an apparatus and a process for casting tubes of stainless steel and superalloys having sluggish metal flow characteristics, and one which affords flexibility to produce the same in several different grades for varied, niche applications and that alleviate the aforementioned drawbacks.

OBJECTS

Some of the objects of the present disclosure, which at least one embodiment herein satisfies, are as follows:

An object of the present disclosure is to provide an apparatus that covers less floor space compared to rolling and forging.

Another object of the present disclosure is to develop a casting process that is partially mechanized to reduce labor requirements compared to conventional sand or investment casting processes.

Still another object of the present disclosure is to develop a casting process that does not rely on sand for mold creation, thereby eliminating defects such as sand inclusions in the final product.

Yet another object of the present disclosure is to develop a casting process that reduces gas entrapment and non-metallic impurities, ensuring a product that achieves the desired mechanical properties consistently.

Still another object of the present disclosure is to develop a casting process that is capable of producing tubes that can withstand high pressures, specifically those exceeding 4.5 bars, to ensure suitability for leak-proof operations.

Yet another object of the present disclosure is to develop a casting process that minimizes defects, particularly in materials susceptible to cracking.

Another object of the present disclosure is to develop a casting process that can be suitable for manufacturing Hard materials like Cobalt Chrome Alloy 6 and work-hardening materials such as M35-1, Cu5MCuC, and CY40, without incurring prohibitive expenses.

Still another object of the present disclosure is to provide an apparatus to cast tubes of sluggish material.

Yet another object of the present disclosure is to provide an apparatus to cast tubes of sluggish material of relatively smaller diameters.

Still another object of the present disclosure is to provide an apparatus to cast tubes of sluggish material which avoids surface cracks.

Yet another object of the present disclosure is to provide an apparatus to cast tubes of sluggish material that avoids sand inclusions.

Still another object of the present disclosure is to provide a process for casting tubes of sluggish material that avoids gas entrapment.

Yet another object of the present disclosure is to provide a process for casting tubes of sluggish material that is less expensive.

Still another object of the present disclosure is to provide a process for casting tubes of sluggish material that offers the versatility to produce cast tubes in a large variety of different material grades.

Yet another object of the present disclosure is to provide a process for casting tubes of sluggish material which allows desirable additions of carbon and other alloying elements as per the ASTM standards for casting heat resistant stainless steels tubes.

Yet another object of the present disclosure is to provide a process for casting tubes of sluggish material which allows desirable additions of sulfur and other alloying elements as per the ASTM standards for casting free machining stainless steel tubes.

Other objects and advantages of the present disclosure will be more apparent from the following description, which is not intended to limit the scope of the present disclosure.

SUMMARY OF THE INVENTION

In accordance with one aspect, the present disclosure envisages an apparatus to cast tubes of sluggish material. The apparatus comprises at least one cylindrical casting mold, heating means, at least one set of rollers, a driving member, at least one tank, a spray nozzle, two end plates, at least one tundish, high temperature gaskets, a reinforced snout and a cooling means. The cylindrical casting mold is configured with a first operative apertured end and a second operative apertured end and the cylindrical casting mold is configured with at least two guide path grooves around the circumference of the mold. The heating means is configured to heat the casting mold. The heating means is configured above the operative top of the casting mold. Each of the rollers of the set of rollers are configured to abut the operative outer surface of the casting mold in the grooves and is further configured to spin the cylindrical casting mold in an operative configuration of the apparatus. The driving member is configured to spin the driving roller (defined below hereafter) and in-turn spin the casting mold and thereon spin the idler roller at the desired speeds. The tank is configured to store refractory coating material therein. The spray nozzle is configured to be connected to the tank and is further configured to introduce the refractory coating material while traversing forward from the first operative apertured end of the casting mold towards the second operative apertured end, wherein the casting mold is spinning at a first speed in the range of 400 RPM-600 RPM, so as to uniformly coat the operative inner surface of the casting mold, with a coat of a predetermined coating thickness in a first operative configuration of the apparatus.

Further, each of the end plates is configured to be attached at each operative end of the casting mold in a second operative configuration of the apparatus. Each of the end plates is defined by a circular-disc shaped plate, with the OD of the end plate being matched to fit at a preconfigured groove at both operative apertured ends in the ID of the casting mold, and the end plate has a through-hole thereon. Furthermore, high temperature gaskets are placed in between the end plates and the above mentioned pre configured groove The tundish is configured to redirect the molten sluggish material, being poured into it from a ladle and change the direction of flow of the molten sluggish material in a desired direction. The reinforced snout is configured to be connected to the tundish. The snout is configured to introduce the molten sluggish material in to the operative inner surface of the casting mold through the second operative apertured end, while the casting mold is spinning at a second speed in the range of 2400 RPM-3000 RPM in the second operative configuration of the apparatus. The snout is configured to be located such that it is axially flush with the second operative aperture end, while introducing the molten sluggish material into the spinning casting mold. The opening of the snout at the tundish end has diameter in the range of 10 mm (0.394 inches) to 10.5 mm (0.413 inches) and has an opening in the range of 4.5 to 5.5 mm (0.177 inches to 0.217 inches) at the mold end, with the opening being spaced apart from the apertured end of the end plates by a distance of 7 to 10 mm (0.276 inches to 0.394 inches). The cooling means is configured to cool the casting mold. The cooling means is configured below the operative bottom of the casting mold. The cooling means is selected from an air-based cooling unit or water based cooling unit.

In an embodiment, the snout is configured with stainless steel needles, wherein the snout is of refractory material.

The rollers in communication with the driving member are configured to spin the casting mold at the first predetermined speed in the first operative configuration and at the second predetermined speed in the second operative configuration to cast tubes of predetermined inner diameters (ID) predetermined outer diameter (OD) and predetermined length.

In an embodiment, the heating means is a gas burner comprising of several gas nozzles that are, configured to heat the casting mold to a temperature in the range of 200° C.-250° C. (392° F.-482° F.) in the first operative configuration of the apparatus.

In an embodiment, the apparatus is configured to cast the tube of a predetermined outer diameter (OD) less than 100 mm (3.937 inches) the predetermined inner diameter (ID) less than 24 mm (0.945 inches) and a predetermined length up to 2000 mm (78.740 inches).

In another embodiment, the apparatus is configured to cast tubes of predetermined outer diameters (OD) in the range of 36 mm-100 mm (1.417 inches-3.937 inches) predetermined inner diameters (ID) in the range of 12 mm-23 mm (0.472 inches-0.906 inches) and predetermined lengths in the range of 1500 mm-2000 mm (59.055 inches-78.740 inches).

In another embodiment, the apparatus is configured to cast tubes of outer diameter (OD) of 70 mm (2.756 inches) predetermined inner diameter (ID) of 12 mm (0.472 inches) and predetermined length greater than 1500 mm (59.055 inches) and less than 2000 mm (78.740 inches).

In another embodiment, the apparatus is configured to cast tubes of predetermined outer diameter (OD) in the range of 36 mm-45 mm (1.417 inches-1.772 inches) predetermined inner diameters (ID) in the range of 12 mm-22 mm (0.472 inches-0.866 inches) and predetermined length greater than 1500 mm (59.055 inches) and less than 2000 mm (78.740 inches).

In an embodiment, the coating thickness on the inner surface of the casting mold is in the range of 0.5 mm (0.020 inches) to 1.5 mm (0.059 inches). The refractory coating material is a slurry formed by mixing silica flour paste with water.

Further in accordance with another aspect, the present disclosure also envisages a process for casting tubes of sluggish material. The process comprises the following steps:

arranging a cylindrical casting mold on at least one set of rollers, the casting mold is configured with a first operative apertured end and a second operative apertured end at extremities of the casting mold;

driving the drive roller and in turn the casting mold and the idler roller so as to spin the set of rollers and the casting mold at predetermined speeds using a driving member;

heating the casting mold up to a predetermined temperature between 200° C.-250° C. (392° F.-482° F.) by using the heating means;

spinning the casting mold at a first speed in the range of 400 RPM-600 RPM;

introducing at least one refractory coating material by means of the spray nozzle in the operative inner surface of the casting mold, via the first operative aperture end;

traversing the spray nozzle forward from the first operative aperture end towards the second operative aperture end to uniformly coat the inner surface of the casting mold with a coating of a predetermined thickness;

stopping the spinning set of the rollers to stop the spinning of the casting mold to enable attachment of pre-coated end plates;

attaching the end plates at each operative end of the casting mold shielded by high temperature gasket;

arranging a tundish at the second operative apertured end;

connecting a reinforced snout to the tundish;

melting the sluggish material in a furnace at a temperature in the range of 1400° C.-1600° C. (2552° F.-2912° F.) for forming the molten sluggish material in the bath;

adding at least one fluidity enhancer to the molten sluggish material in the bath;

spinning the casting mold at a second speed in the range of 2400 RPM-3000 RPM;

tapping the molten sluggish material from the bath into a ladle;

transporting the ladle to the tundish;

introducing the molten sluggish material in to the operative inner surface of the casting mold through the second operative apertured end, via the tundish and snout to centrifugally disperse the molten sluggish material along the length of the inner surface of casting mold;

cooling the casting mold to a temperature in the range of 200° C.-250° C. (392° F.-482° F.) by means of the cooling means to solidify the molten sluggish material to cast the tube of the predetermined inner diameter (ID), the predetermined outer diameter (OD) and the predetermined length;

stopping the spinning of the casting mold;

loosening and removing the end plates from the operative ends of the casting mold; and taking out the cast tube from the casting mold.

In an embodiment, the process further comprises the following steps:

adding at least one fluidity enhancer and one deoxidizing element to the molten sluggish material in the bath in the furnace;

shielding the molten sluggish material with a protective synthetic slag; and cleaning-out the slag before introducing the molten sluggish material into the operative inner surface of the casting mold.

In an embodiment, the fluidity enhancer is at least one selected from a group consisting of Carbon in the range of 0.015-1.3% of the mass of molten sluggish metal and Silicon in the range of 0.25-2.5% of the mass of the molten sluggish material.

In another embodiment, the deoxidizing element is at least one selected from a group consisting of ferro-titanium, ferro-boron, lanthanum, having ferro-titanium in the range of 0.1-0.5% of the mass of molten sluggish metal, Ferro Boron in the range of 0.1-2.0% of the molten sluggish metal, and lanthanum in the range of 0.02-0.1% of mass of the molten sluggish metal.

In an embodiment, the step of spinning said casting mold is performed at said first speed in the range of 400 RPM-600 RPM and a second speed in the range of 2400 RPM-3000 RPM.

In another embodiment, the step of introducing the molten sluggish material in the casting mold is performed at a pouring temperature in the range of 1400° C.-1600° C. (2552° F.-2912° F.).

In an embodiment, the step of selecting the rpm at which the casting mold is spun depends upon the volume of the molten sluggish material utilized in the process.

In another embodiment, the step of introducing the molten sluggish material in the operative inner surface of the casting mold, wherein the snout is arranged in a manner that the opening of the snout is positioned to be axially flush with the apertured end of the end plate and spaced apart from it by a distance is in the range of 7-10 mm (0.276 inches-0.394 inches).

In an embodiment, the process used for casting the tube having a predetermined outer diameter (OD) less than 100 mm (3.937 inches), predetermined inner diameter (ID) less than 24 mm (0.945 inches), and predetermined length up to 2000 mm (78.740 inches).

In an embodiment, the molten sluggish material is selected from a group consisting of at least one from stainless steel, superalloys with either high Nickel, Chromium, Molybdenum, Copper content, or a combination thereof.

In an embodiment, the coating thickness on the inner surface of the casting mold is in the range of 0.5 mm to 1.5 mm (0.020 inches to 0.059 inches).

Furthermore, in accordance with another aspect, the cast tube (36) of predetermined outer diameter (OD) in the range of 36 to 100 mm (1.417 inches-3.937 inches), predetermined inner diameter (ID) in the range of 12 mm to 23 mm (0.472 inches-0.906 inches) and predetermined length in the range of 1500 mm to 2000 mm (78.740 inches) is made by the apparatus (100) and process of the present disclosure.

BRIEF DESCRIPTION OF THE DRAWINGS

An apparatus to cast tubes of sluggish material and a process thereof, of the present disclosure, will now be described with the help of the accompanying drawing, in which.

LIST OF REFERENCE NUMERALS

Figure 1:
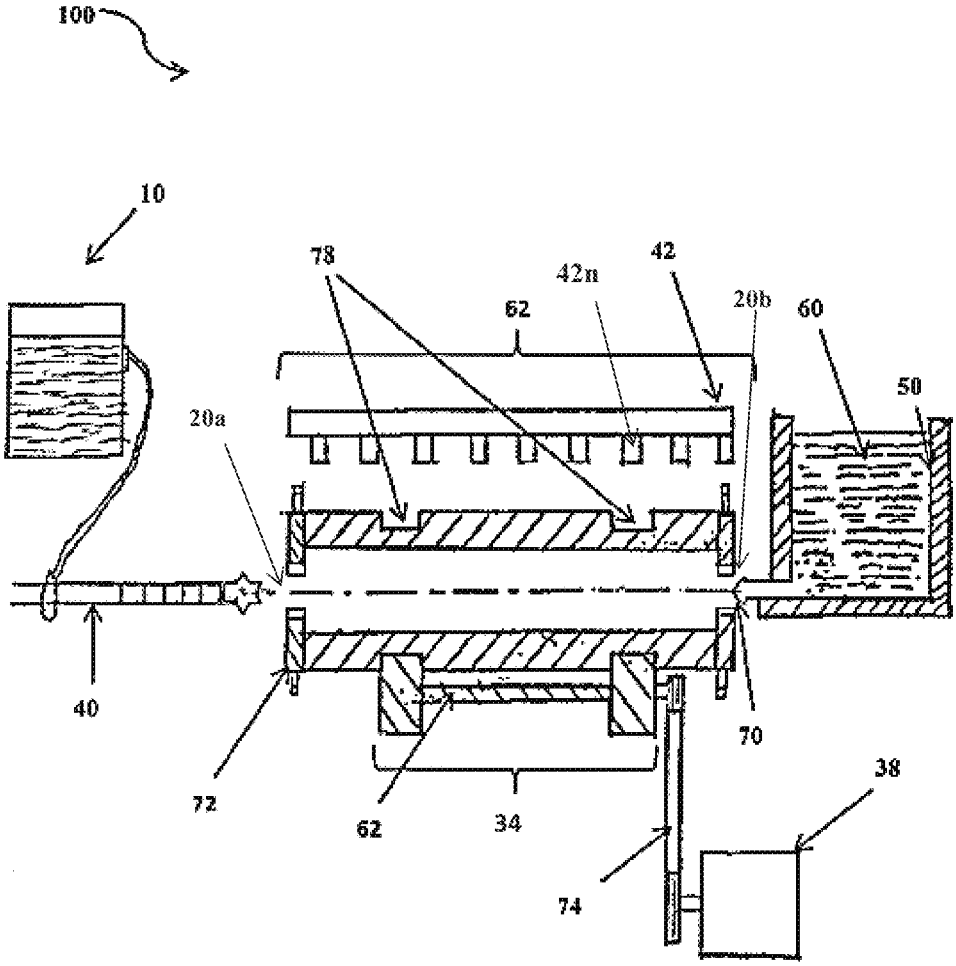
FIG. 1 illustrates an apparatus to cast tubes in accordance with an embodiment of the present disclosure.

| | |
|---|---|
| 100 | Apparatus |
| 10 | Tank |
| 20 | cylindrical casting mold |
| 20a | first operative apertured end |
| 20b | second operative apertured end |
| 32 | Idler roller |
| 34 | driving roller |
| 36 | pipe or cast tube of sluggish material (being formed) |
| 36 a | thin cast tube |
| 36 b | thick cast tube |
| 38 | driving member |
| 40 | spray nozzle |
| 42 | heating means |
| 42n | burner nozzle |
| 44 | cooling means |
| 50 | tundish |
| 60 | molten sluggish material |
| 62 | machine shaft |
| 70 | reinforced snout |
| 72 | end plates |
| 74 | belt drive |
| 76 | coated inner operative surface of casting mold |
| 78 | guide path groove |
| 80 | groove |
| 82 | gaskets |

DETAILED DESCRIPTION

Embodiments, of the present disclosure will now be described with reference to the accompanying drawing. Embodiments are provided so as to thoroughly and fully convey the scope of the present disclosure to a person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a", "an", and "the" may be intended to include the plural forms as well, unless the context clearly suggests otherwise. The terms "comprises", "comprising", "including", and "having", are open ended transitional phrases and therefore specify the presence of stated features, integers, steps, operations, elements, modules, units and/or components, but do not forbid the presence or addition of one or more other features, integers, steps, operations, elements, components, and/or groups thereof. The particular order of steps disclosed in the method and process of the present disclosure is not to be construed as necessarily requiring their performance as described or illustrated. It is also to be understood that additional or alternative steps may be employed.

When an element is referred to as being "mounted on", "engaged to", "connected to", or "coupled to" another element, it may be directly on, engaged, connected or coupled to the other element. As used herein, the term "and/or" includes any and all combinations of one or more of the associated listed elements.

Terms such as "inner", "outer", "beneath", "below", "lower", "above", "upper", and the like, may be used in the present disclosure to describe relationships between different elements as depicted from the figures.

Typically, the horizontal centrifugal casting process is currently used for the casting of tubes. However, the length of tube that can be casted is limited to the practicable length to which a material may be cast in the form of the tube of the desired dimensions. Tubes, produced by the Centrifugal or Spun Casting process are usually having OD's greater than 60 mm (2.362 inches). And, in some cases, they have an OD of 60 mm (2.362 inches) and an ID of about 25-30 mm (0.984 inches-1.181 inches). However, the casting of smaller size tubes (lower than 25 mm ID's (0.9842 inches) is difficult, especially in a length of one meter (39.37 inches) or more. Further, other conventional methods of manufacturing tubes, such as solid drawing for thin-walled tubing, or welding and drawing also involve numerous process steps, which are expensive and require a considerably large amount of space.

To overcome the aforementioned drawbacks, the present invention envisages an apparatus to cast tubes of sluggish material.

The apparatus 100 comprises at least one cylindrical casting mold 20, at least one set of rollers 32, 34, two end plates 72, a driving member 38, at least one tank 10, a spray nozzle 40 typically a vfd controlled spray nozzle, which may be motorized, at least one tundish 50, a reinforced snout 70, high temperature gaskets 82, heating means 42 and a cooling means 44. A plurality of apparatus 100 can be arranged linearly or parallelly on a shop floor and a single tank 10, and a single tundish 50 may be configured to sequentially feed a plurality of the linearly or parallelly arranged casting molds 20. With reference to FIG. 1, the cylindrical casting mold 20 is defined by a hollow tubular shaped casting mold with two open apertured ends 20*a*, 20*b* at its extremities, and configured with at least one pair of guide path grooves 78 around the outer circumference of the mold 20. Each of the two open extremities 20*a*, 20*b* are configured to receive an end plate 72 therein. Each of the end plates are defined by a circular-disc shaped plate, having a thickness of 35 mm (1.378 inches), with the OD of the end plate being matched to fit at a preconfigured groove 80 in the ID at each apertured end of the mold, and the end plate having a through-hole of diameter 10 mm (0.394 inches) thereon. The end plates are precoated. The end plates 72 have an inner diameter (ID), which is less than the ID of the tube or pipe 36 to be cast. The end plates 72 are arranged and locked with the operative ends of the casting mold 20 by means of a plurality of tapered wedge pins. The end plates 72 as well as the cast tube 36 will remain intact with the casting mold 20 during operation of the apparatus 100. Therefore, the end plate 72 with the casting mold 20 defines a first operative apertured end 20*a* and a second operative apertured end 20*b* at the two extremities of the casting mold 20. The arrangement of the different components shown in the FIG. 1 or subsequent figures is scaled for representation and demonstration. The high temperature gaskets 82 are placed in between the end plates 72 and a groove 80 configured in the ID, at both operative apertured ends 20*a*, 20*b* of the casting mold 20.

Advantageously, the centrifugal casting process utilizes metallic dies or molds, which significantly differ from the molds employed in the conventional sand casting process. In sand casting, sand is used as the primary material to create molds. The conventional sand casting frequently results in defects such as sand inclusions. In contrast, using metallic dies in centrifugal casting eliminates the occurrence of such defects. Consequently, centrifugal casting offers a distinct advantage over sand casting by avoiding major defects like sand inclusions.

In an embodiment, the end plates 72 having a thickness of 35 mm (1.378 inches) and with an ID of 10 mm (0.394 inches) with each being shielded by a high temperature self-standing ceramic gasket 82 of thickness 20 mm (0.787 inches), are placed at each end of the mold. The OD of the end plate 72 is matched to fit a preconfigured groove 80 in the ID at each apertured end of the casting mold 20.

In an embodiment, the endplates are pre-coated with refractory material.

In another embodiment, the OD and ID of the high temperature gasket 82 are cut so as to match the circumference of the end plates 72.

In another embodiment, the high temperature gaskets 82 are placed in between the end plate 72 and a groove 80 a preconfigured groove 80 in the ID at each operative aperture ends 20*a*, 20*b* of the casting mold 20. The gaskets 82 are placed at the configured groove 80 and extend beyond the operative inner surface of the casting mold 20 at both ends, such that the gaskets 82 abut the end plates 72. Thus, the gaskets 82 serve as a barrier for protecting the end plate 72 from fusing with the molten sluggish material.

In one embodiment, wedge shaped metallic tapered pins are hammered, through 3 equidistant slots, at each end of the casting mold 20, with the tapered section pointing outward towards the mold OD. These tapered pins abut against the outside of the end plate 72 and hold the same in place. Due to the tapered wedge-shaped design, the tapered pins fit in tightly, thus forming a reliable seal.

Further, the casting mold 20 is made from a standard bar of 160 mm (6.299 inches) OD. The bar is cut in a length so as to make it suitable for obtaining the desired cast length of the cast tube and the bore is machined so as to make it suitable for obtaining the desired cast OD of the cast tube or pipe 36. RPM for the mold is empirically selected based on the ID of the pipe 36 to be cast. The maximum RPM of 2900 rpm is selected for 12 mm ID (0.472 inches). It is empirically determined to reduce the speed by 50 rpm for every 1 mm (0.039 inches) increase in ID. The empirical selection of the RPM is chosen in such a manner so as to allow for achieving the desired ID of the pipe, while maintaining the minimal vibration in the mold 20 as well as minimal generation of residual stress in the cast pipe. Further, the cast pipes 36 are inspected after shot blasting in order to check for any stress related defects such as cracks.

The casting mold 20 is configured to rotate by means of at least one set of rollers 32, 34. The set of rollers 32, 34 comprises at least one machine shaft 62 idler roller 32, one driving roller 34, configured to support and spin the mold 20. The machine shaft 62 connects each roller to the back wheel of the roller, making up the rolling assembly. Each of the rollers 32, 34 in the assembly are configured to abut or score the guide path grooves 78 of the casting mold 20. The rollers 32, 34 are driven by a driving member 38. The driving member 38 is a motor and drive control unit. The driving member 38 is connected to the drive roller 34 by means of either a chain link (not shown) or a belt drive 74.

In an embodiment, the machine shaft 62 and the rollers 32, 34 are of toughened EN8 material.

Figure 2A:
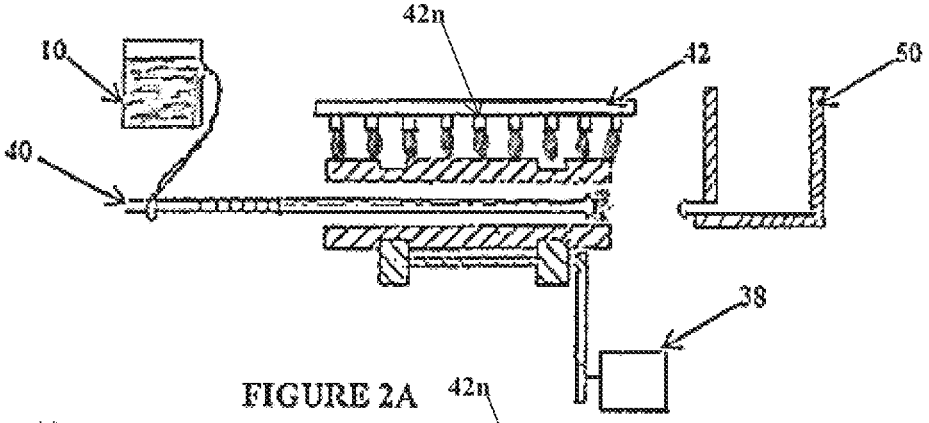
FIG. 2A-2C illustrates a sequence of stage for casting a tube by centrifugal action in accordance with an embodiment of the present disclosure.
Figure 2B:
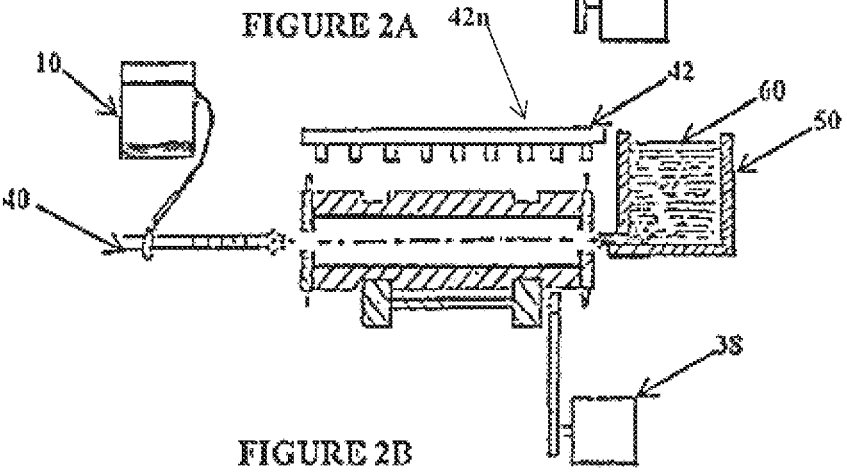
Figure 2C:
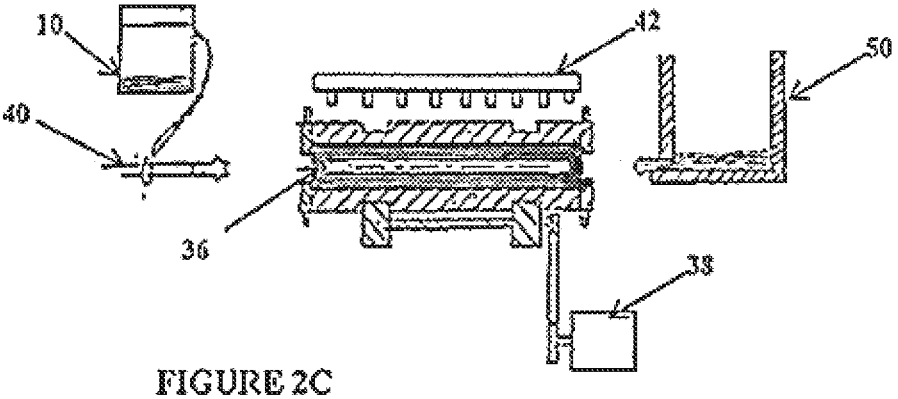
Figure 3:
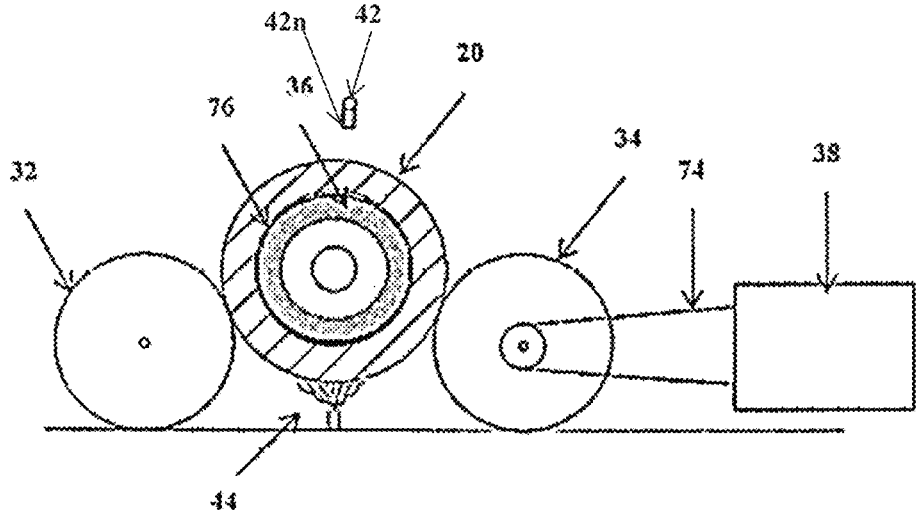
FIG. 3 illustrates a set of rollers utilized to drive a cylindrical casting mold in accordance with an embodiment of the present disclosure.
Figure 3A:
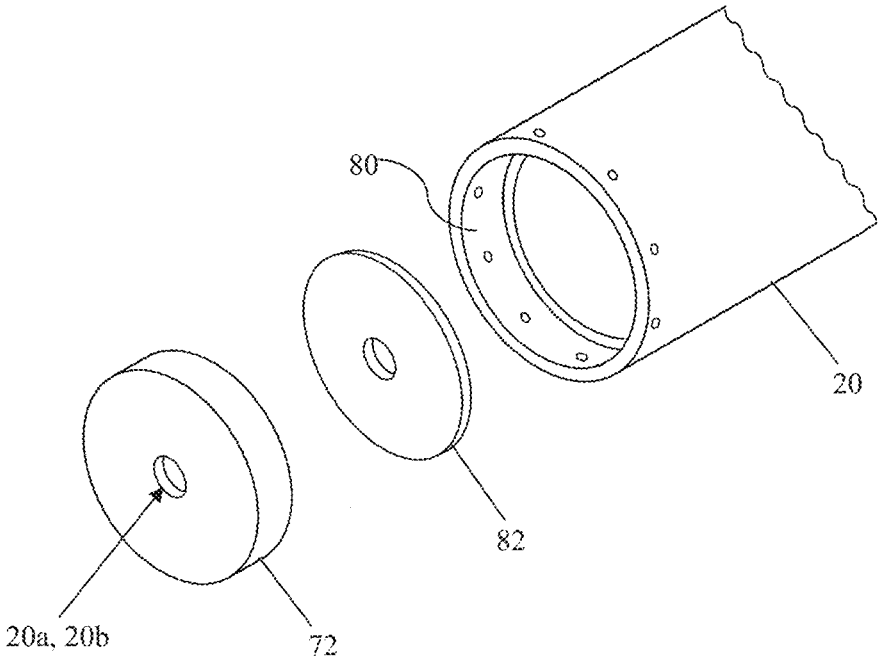
FIG. 3A illustrates a cylindrical casting mold showing the apertured end and groove configured at the end in which a gasket and end plate is mounted.

Further, the driving member 38 drives the driving roller 34 and transmits the driving power through a timing belt. The driving rollers transmit the drive power to the casting mold 20. Thus, the driving member 38 is configured to drive the roller 34 to enable the spinning of the casting mold 20 at a first speed while spraying refractory coating material on to the operative inner surface of the casting mold 20 in a first operative configuration of the apparatus 100 and further, at a second speed to centrifugally uniformly disperse the molten sluggish material 60 on the inner surface of the casting mold 20 to cast the tube 36 of the predetermined inner diameter (ID), outer diameter (OD) and a predetermined length in a second operative configuration of the apparatus 100. The driving member also includes the drive control unit which is configured to spin the casting mold 20 at the first speed and at the second speed. FIG. 2A-2C illustrates a sequence of stage for casting a tube by centrifugal casting. FIG. 3 illustrates a roller utilized for the driving of the cylindrical casting mold 20 in accordance with an embodiment of the present disclosure. FIG. 3A illustrates a cylindrical casting mold 20 showing the apertured end and groove 80 configured at the end in which the gasket 82 is mounted.

In an embodiment, the driving member 38 includes the motor and the drive control unit, configured to drive the apparatus 100. The motor is a 15HP motor and the drive control unit is configured to spin the casting mold 20 at the first speed and at the second speed.

Further, the heating means 42 is configured to heat the casting mold 20. The heating means 42 is configured above the operative top of the casting mold 20. In an embodiment, the heating means 42 is a gas burner comprising of a plurality of gas nozzles 42*n* that are mounted on the top in a row via a manifold pipe. This configuration ensures that the casting mold 20 is uniformly heated along its length while coating the operative inner surface.

As can be seen from the above description, the centrifugal casting process is partially mechanized and requires significantly less labor compared to traditional sand casting or investment casting processes.

In an embodiment, the heating means 42 is configured to heat the casting mold 20 to a temperature in the range of 200° C.-250° C. (392° F.-482° F.) during the first operative configuration of the apparatus 100.

Further, the tank 10 is configured to store the refractory coating material therein. The spray nozzle 40 is configured to be connected to the tank 10. The spray nozzle 40 is configured to introduce the refractory coating material through the first operative apertured end at a first speed to uniformly coat the operative inner surface of the casting mold 20 with a predetermined coating thickness in the first operative configuration of the apparatus 100. The coating is applied to the inner surface of the cylindrical mold 20 prior to dispersing or introducing the molten sluggish material 60 in the casting mold 20 in the second operative configuration of the apparatus (100).

In an embodiment, the coating thickness of the refractory coating material is in the range of 0.5 mm (0.020 inches) to 1.5 mm (0.059 inches) typically 1.0 mm (0.039 inches).

In an embodiment, the refractory coating material that is stored in the tank is a slurry formed by mixing silica flour paste with water.

In an embodiment, the set of rollers 32, 34 are configured to spin the casting mold 20 in the first operative configuration of the apparatus 100 at the first speed being in the range of 400 RPM-600 RPM.

Further, parallelly the molten sluggish material 60 of a desired chemical composition is formed by melting the sluggish material in a furnace with a suitable alloying element. In an embodiment, the molten sluggish material 60 is produced by melting stainless steel (or a super alloy) with suitable alloying elements in an induction furnace, electric arc furnace, cupola furnace, or crucible furnace, under a synthetic slag cover, which shields the molten sluggish material from atmospheric contamination. The molten sluggish material 60 is allowed to be mixed with at least one fluidity enhancer and at least one deoxidizing element. The fluidity enhancer increases the fluidity of the molten liquid, thus ensuring complete coverage of the inner surface of the mold 20 before the molten sluggish material 60 starts to solidify. The deoxidizers, fluidity enhancers and optionally metal cleansers enable the apparatus 100 to cast even small size pipes of predetermined lengths and diameters.

In a preferred embodiment, the molten sluggish material 60 is at least one selected from a class of stainless steel and superalloys having high amounts of either Nickel, Chromium, Molybdenum, Copper content, or a combination thereof.

In addition, the molten sluggish material 60 is covered by a synthetic slag during the melting process. The synthetic slag is cleaned off just before introducing into the tundish 50. Therefore, it minimizes the oxidation or atmospheric contamination of the molten sluggish metal from which the tube or the pipe 36 is being cast. The synthetic slag includes magnesia, chalk, dolomite, corundum, lime, cristobalite, and potash. The synthetic slag provides a protective cover to minimize oxidation of the molten sluggish material. This in turn also increases the cleanliness of the metal, which is important for allowing the free flow of molten sluggish material through the narrow snout 70, reducing the chances of any blockages in the same by minimizing non-metallic impurities.

In an embodiment, the fluidity enhancer is selected from a group consisting of Carbon in the range of 0.015-1.3% of the mass of the molten sluggish metal and Silicon in the range of 0.25-2.5% of the mass of the molten sluggish metal.

The molten sluggish material 60 is tapped from the furnace in to a ladle; and thereby it is transported and transferred in to a tundish 50. The tundish 50 is configured to connect a reinforced snout 70 and is used to receive the molten sluggish material 60 from the ladle and change the direction of flow of the molten sluggish material in a desired direction. The snout 70 is configured to be in communication with the second apertured end 20*b* of the casting mold 20, and further configured to introduce the molten sluggish material 60 in to the casting mold 20 through the second operative apertured end 20*b* at the second speed in the second operative configuration of the apparatus 100.

In an embodiment, the set of rollers 32, 34 are configured to rotate the casting mold 20 in the second operative configuration of the apparatus 100 at the second speed in the range of 2400 RPM-3000 RPM.

In another embodiment, the molten sluggish material 60 is introduced into the casting mold at a pouring temperature in the range of 1400° C.-1600° C. (2552° F.-2912° F.).

In an embodiment, the snout 70 is spaced apart at a distance of 7 mm-10 mm (0.276 inches-0.394 inches) typically 8 mm (0.315 inches) from the aperture of the end plate 72 at the pouring end. Therefore, any vibration produced in the casting mold 20 while spinning will not be transmitted to the snout 70 or the tundish 50. The snout, with a refractory nozzle fitted to it at the bottom on one end is preheated to a red hot temperature of at least 700-800° C. (1292° F.-1472° F.) by a high flame gas burner.

In an embodiment, the snout is of 400 mm length×350 mm width×300 mm height (15.748 inches×13.780 inches×11.811 inches).

In an embodiment, the diameter of the snout 70 is less than the diameter of the end plate aperture.

In an embodiment, snout 70 is reinforced with metal needles, which has an inner diameter of 4.5 mm-5.5 mm (0.177 inches-0.217 inches) at the outlet, typically 5 mm (0.197 inches), through which the molten sluggish metal 60 flows in to the casting mold 20. The reinforced snout is placed at the second apertured end 20*b* end of the casting mold 20. i.e. located such that it is axially flush with the second operative apertured end 20*b*, such that it closes the mouth of the casting mold 20 as much as possible, leaving an air gap of 7-10 mm, (0.278 inches-0.394 inches) typically from the end plate edge. The air gap is maintained so as to shield the reinforced snout from vibrations that may occur in the rotating mould, which can upset the fine alignment between them.

In an embodiment, the air gap between the reinforced snout 70 and the second operative apertured end of the casting mold should not be greater than 10 mm (0.394 inches) and not less than 7 mm (0.276 inches). A gap greater than 10 mm (0.394 inches) prevents the molten sluggish material 60 from reaching into the casting mold 20 and can result in the metal spilling out onto the end plate 72. A minimum gap of 7 mm (0.276 inches) is maintained so as to provide for an air separation between the reinforced snout 70 and the mold 20. In another embodiment, the casting mold 20 is made of 30CrMo Steel with a run-out ranging between 0.002 mm-0.1 mm (0.0001 inches-0.004 inches) to minimize vibrations.

Further, cooling means 44 is configured below the operative bottom of the casting mold 20 and further configured to cool the casting mold 20 after introducing the hot molten sluggish material 60 therein. In an embodiment, the cooling means 44 is selected from an air-based cooling unit or a water based cooling unit. The cooling means 44 facilitates the spray of coolant over the periphery of the casting mold 20 to achieve cooling along the length of the casting mold 20. In turn, the mold cools the sluggish molten metal directionally from the OD to the ID, thus causing it to solidify. Therefore, the rollers 32, 34 are configured to spin the casting mold at the first speed in the first operative configuration and at the second speed in the second operative configuration to cast the tubes 36 of a predetermined inner diameter (ID), a predetermined outer diameter (OD) and a predetermined length.

In one embodiment, the apparatus 100 is configured to cast the tube 36 of predetermined outer diameter (OD) less than 100 mm (3.937 inches), the predetermined inner diameter (ID) less than 24 mm (0.945 inches), and a predetermined length up to 2000 mm (78.740 inches).

In another embodiment, the apparatus 100 is configured to cast the tube 36 of outer diameter (OD) in the range of 36 mm-100 mm (1.417 inches-3.937 inches), inner diameter (ID) in the range of 12 mm-23 mm (0.472 inches-0.906 inches), and length in the range of 1500-2000 mm (59.055 inches-78.740 inches).

In another embodiment, the apparatus 100 is configured to cast the tube 36 of outer diameter (OD) of 70 mm (2.756 inches), inner diameter (ID) of 12 mm (0.472 inches) and length less than 2000 mm (78.740 inches).

In another embodiment, the apparatus 100 is configured to cast the tube 36 of outer diameter (OD) in the range of 36 mm-45 mm (1.417 inches-1.772 inches), inner diameter (ID) in the range of 12 mm-22 mm (0.472 inches-0.866 inches), and length in the range of 1500-2000 mm (59.055 inches-78.740 inches).

Further, when the casting mold 20 spins at the predetermined speed, the molten sluggish material 60 is uniformly dispersed on the inner surface inside the casting mold 20 and enables the casting mold 20 to promote directional solidification by means of the cooling means 44, located operatively below the casting mold 20. With the spinning of the casting mold 20, the lighter non-metallic impurities get separated near to the inner periphery of the formed tube 36 and gas escapes through the hollow ID. And, therefore there is no possibility of gas entrapment or sand inclusion.

FIG. 3A illustrates a cylindrical casting mold showing the apertured end and groove 80 configured at the end in which the gasket is mounted.

1. As shown in FIG. 3A, the casting mold 20 is configured with grooves 80 at both ends, and the gasket 82 is configured to fit within the grooves 80. Additionally, the endplates 72 are configured to fit into the grooves 80 at the ends of the casting mold 20, with the gasket 82 positioned between the grooves 80 and the endplates 72. When the endplates 72 are fully inserted into the casting mold 20, the endplates 72 along with the gasket 82 form an effective barrier and prevent the molten metal from flowing out of the mould. Further, the end plates are held in position by tapered wedge holding pins (not shown) that are hammered through the pin holes that are shown on the surface of the mould, such that the thin tapered section points towards the OD of the mould, while the thicker head of pin abuts against the face of the end plate and locks it into position. Further, under the application of centrifugal force, the tapered wedge holding pins fit even tighter into the holes, as a result of the outward acting centrifugal force, making the locking mechanism seal proof. Further, the endplates 72 are configured with the first operative aperture 20*a* and the second operative aperture 20*b*. Furthermore, the first operative aperture 20*a* and the second operative aperture 20*b* in the casting mold 20 are co-axial with the hole in the gasket 82.

Figure 4A:
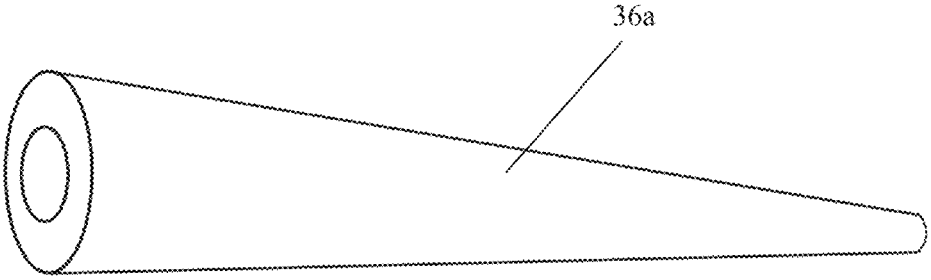
FIG. 4A illustrates an isometric view of a thinner cast tube of sluggish material in accordance with an embodiment of the present disclosure.
Figure 4B:
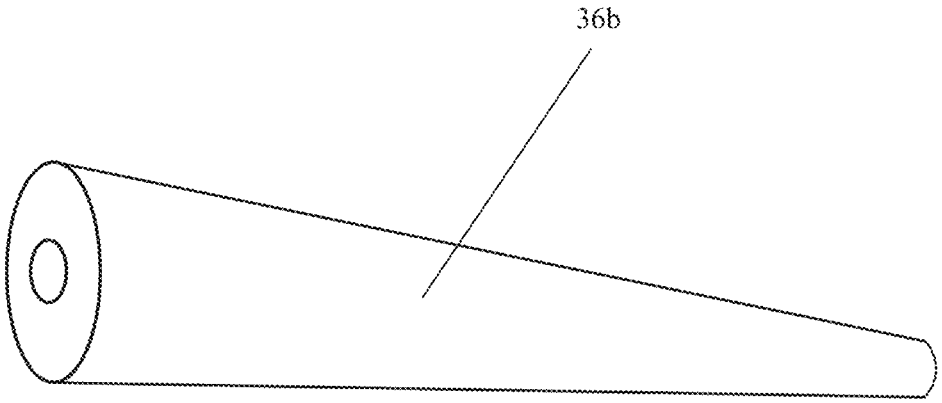
FIG. 4B illustrates an isometric view of a thicker cast tube of sluggish material in accordance with an embodiment of the present disclosure.

Therefore the present disclosure envisages a process for casting tubes 36 of the molten sluggish material 60. FIG. 4A illustrates an isometric view of a thin cast tube (36 *a*) of sluggish material and FIG. 4B illustrates an isometric view of thick cast tube (36 *b*) of sluggish material in accordance with embodiments of the present disclosure. In an embodiment, the dimensions of the tube (36 *a*) shown in FIG. 4A are 45 mm OD×22 mm ID×1500 mm (1.772 inches×0.866 inches×59.055 inches) Length and the dimensions of the tube (36 *b*) shown in FIG. 4B are 45 mm OD×12 mm ID×1500 mm Length (1.772 inches×0.472 inches×59.055 inches).

Furthermore, an important characteristic of the centrifugal casting process is its ability to form tubes under centrifugal force. The centrifugal force acts similarly to a centrifuge, purifying the metal by filtering out lighter, non-metallic contaminants and gases. The impurities are pushed towards the inner periphery which can then be machined out. This effectively addresses two common defects in sand or investment castings: non-metallic inclusions and gas porosity.

Moreover, tubes cast using centrifugal pressure exhibit excellent pressure tightness. When subjected to a soap solution test under 5 bar pressure for 5 minutes, these tubes are found to be leak-free. In contrast, achieving pressure tightness in a hollow sand or investment casting pipe over lengths of 1.5 to 2 meters (59.055 inches to 78.740 inches), or even greater, is difficult.

The sequence of steps involved in coating the cylindrical mold 20 in the first operative configuration of the apparatus (100), are as follows:

- the cylindrical casting mold 20 is loaded onto the set of rollers 32, 34 and rotated at around 300 rpm;
- the mold 20 is heated by using the heating means 42 attached to the manifold from the top at a predefined angle;

the refractory coating material is then filled into the tank 10 pressurized at 60 PSI through a pneumatic air connection;

the refractory coating material is sprayed using a vfd controlled spray nozzle (40) having a diameter, of 30 mm-35 mm (1.181 inches-1.378 inches) typically 33 mm (1.299 inches), which is moved forward or reverse in the casting mold using a VFD connected motor;

the amount of coating being sprayed for a time period of 10 seconds, at a tank pressure of 60 PSI, is measured. The amount of seconds required to spray the entire weight of the coating is accordingly calculated using ratio and proportion. The spray nozzle 40 speed is then adjusted manually by a power pot so that it traverses the entire length of the mold 20, from one end to other end, within the same number of seconds;

then the casting mold 20 is rotated at a first predetermined speed and the spray Nozzle 40 is carefully inserted into the ID of the mold 20;

the coating is sprayed starting from the first operative aperture end 20*b* of the mold 20, at the above set speed. The spray nozzle 40 traverses at a uniform speed for the set number of seconds, via the motorized VFD, ending at the second operative aperture end to uniformly coat the operative inner surface of the casting mold 20 with the refractory coating;

the moisture from the coating dries instantaneously at the time of deposition of the coating, thus curing the same; and the spinning of the casting mold 20 is then stopped.

In an embodiment, the casting mold 20 is rotated by means of a driving member (38), which in this case is a VFD controlled motor, which rotates the machine shaft assembly by using a belt drive 74.

In another embodiment, the temperature of the mold 20 is monitored through a hand-held Infrared Pyrometer having emissivity value set at 0.9.

In one embodiment, a water-based silica flour refractory coating material is used, which is pre-mixed for about 5 minutes. The specific gravity of the refractory coating material is measured by a dip hydrometer. Potable tap water is added as desired to achieve the desired Baume reading of 40-45 Baume. The desired coating weight is calculated using the following formula: [(Pipe OD in mm) multiplied by (Tube Length in mm) divided by constant 0.13 in order to achieve a coating thickness of 1 mm (0.039 inches)]. The amount of coating being sprayed for a time period of 10 seconds, at a tank pressure of 60 PSI, is measured. The amount of seconds required to spray the entire weight of the coating is accordingly calculated using ratio and proportion.

In an embodiment, the first predetermined speed of the casting mold 20 for coating is in the range of 400 RPM-600 RPM, typically 500 RPM.

In accordance with another aspect of the disclosure, the process for casting tube 36 of the sluggish material using the apparatus described above comprises the following steps:

arranging the cylindrical casting mold 20 on at least one set of rollers 32, 34, said casting mold has a first operative apertured end and a second operative apertured end at extremities of the casting mold 20;

driving the set of rollers 32, 34 to spin the casting mold 20 at the predetermined speeds using the driving member 38;

heating the casting mold 20 for a predetermined temperature between 200° C.-250° C. (392° F.-482° F.) by using the heating means 42;

spinning the casting mold (20) at a first speed in the range of 400 RPM-600 RPM;

introducing the refractory coating material by means of the spray nozzle 40 in the operative inner surface of the casting mold 20 through the first operative apertured end 20*a;* traversing the spray nozzle 40 forwards from the first operative aperture end 20*a* towards the second operative aperture end 20*b* to uniformly coat the operative inner surface of the casting mold 20 with a refractory coating of a predetermined thickness;

stopping the set of rollers 32, 34 to stop the spinning of the casting mold 20 to enable attachment of the pre coated end plates 72;

attaching the end plates 72 at each operative end of the casting mold 20 shielded by high temperature gaskets 82;

arranging a tundish 50 at the second operative apertured end 20*b;* connecting the reinforced snout 70 to the tundish 50;

melting sluggish material in a furnace at a temperature in the range of 1400° C.-1600° C. (2552° F.-2912° F.) for forming the molten sluggish material in the bath;

adding at least one fluidity enhancer to the molten sluggish material in the bath;

spinning the casting mold 20 at the second speed in range of 2400 RPM-3000 RPM;

tapping the molten sluggish material 60 from the bath into a ladle;

transporting the ladle to the tundish 50;

introducing the molten sluggish material 60 in the operative inner surface of the casting mold 20 through the second operative apertured end 20*b*, via the tundish and snout to centrifugally disperse the molten sluggish material 60 uniformly along the length of the casting mold 20;

cooling the casting mold 20 to a temperature in the range of 200° C.-250° C. (392° F.-482° F.) by means of cooling means 44 in order to cast the tube 36 of a predetermined inner diameter (ID), a predetermined outer diameter (OD) and a predetermined length;

stopping the spinning of the casting mold 20; and loosening and removing the end plates 72 from the operative ends 20*a*, 20*b* of the casting mold 20; and taking out the cast tube 36 from the casting mold 20.

In an embodiment, the step of transporting the ladle to the tundish 50 is performed by means of an overhead crane.

Further, once the casting of one tube 36 completes, the tube comes out with the traces of the coated material over its surface. Therefore, it is required to brush clean or shot blast the surface of the cast tube 36 before using it for a further application.

In an embodiment, the step of spinning the casting mold 20 is performed at the first speed in the range of 400 RPM-600 RPM and the second speed in the range of 2400 RPM-3000 RPM.

In an embodiment, the step of introducing the molten sluggish material 60 in the casting mold 20 is performed at a pouring temperature in the range of 1400° C.-1600° C. (2552° F.-2912° F.).

In an embodiment, the process for casting tube 36 further comprises the steps of:

adding the at least one deoxidizing element to the molten sluggish material 60 in the bath in the furnace;

shielding the molten sluggish material 60 with the protective synthetic slag; and cleaning-out the slag before introducing the molten sluggish material 60 into the operative inner surface of the casting mold 20.

In an embodiment, the process includes the step of introducing the molten sluggish material 60 in the operative inner surface of the casting mold 20, wherein the snout is arranged in the manner that the opening of the snout is positioned to be axially flush with the apertured end of the end plate and spaced apart from it by a distance of 7-10 mm (0.276 inches-0.394 inches). In an embodiment, the step of spinning the casting mold 20 involves spinning of the casting mold for a predetermined time in the range of 4.5 min-6.5 min. The step of spinning the casting mold i.e. the speed at which it is spun and the time for which it is spun depends upon the volume of the molten sluggish material 60 utilized in the process of casting the tubes 36.

The sequence of steps involved in extraction of pipe or tube 36 from the cylindrical casting mold 20 are as follows:

- water cooling is continued until the molten sluggish metal in the casting mold 20 solidifies;
- the spinning of the casting mold 20 is gradually brought to a halt;
- the tapered wedge holding pins are knocked off from each side of the end plates 72 and the end plates 72 are manually removed;
- the front end of a TMT bar of desired length with a threaded end is inserted through the first operative aperture end 20*a*; and
- a circular plate which is smaller than the OD of the casted tube, but which is bigger than the ID of the casted tube is bolted to the threaded end, after the threaded end protrudes out from the second operative apertured end 20*b;*
- the circular plate is made to abut the face of the pipe at the second operative apertured end 20*b;*
- the back end of the TMT bar is connected to a motorized puller puller/winch through a wire rope. As the winch drum is rotated slowly, the wire rope retracts pulling the cast pipe out with it.

In an embodiment, the process involves casting the tube 36 of the predetermined outer diameter (OD) less than 100 mm (3.937 inches), predetermined inner diameter (ID) less than 24 mm (0.945 inches), and the predetermined length up to 2000 mm (78.740 inches).

In another embodiment, the process involves casting the tube (36) of a predetermined outer diameter (OD) in the range of 36 mm-100 mm (1.417 inches-3.937 inches) a predetermined inner diameter (ID) in the range of 12 mm-23 mm (0.472 inches-0.906 inches) and a predetermined length in the range of 1500 mm-2000 mm (59.055 inches-78.740 inches).

Further, once the casting of one tube is completed, the operative inner surface of the casting mold 20 is cleaned by a wire brush and once again the same cycle of the process of casting of tube starts.

In an embodiment, the coating thickness on the inner surface of the casting mold (20) is in the range of 0.5 mm to 1.5 mm (0.020 inches to 0.059 inches).

Since, the addition of fluidity enhancer increases the fluidity of the molten sluggish material inside the mold; advantageously smaller diameter tubes of sluggish material can be produced by this process. Further, by the addition of the deoxidizing element, and by virtue of the centrifuging action of the centrifugal force, the impurities get refined and migrate to the ID and further the gases also migrate to and escape from the ID. Hence, advantageously the tubes produced by this process do not have entrapped inclusions or gas porosities.

In an embodiment, the impurities migrate to the ID of the tube (inner surface) can be thereafter be machined and used, if the inner surface is a critical surface.

In another embodiment, if the ID of the tube is not a critical surface, then the tube can be used as is in as-cast condition.

Other competing processes such as forging and rolling, in which the materials are processed in the solid state, often lead to the formation of cracks. However, minimizing vibrations and selecting the appropriate rotational speed (RPM) are crucial factors in producing crack-free centrifugally cast tubes. This precision allows the production of several grades by the centrifugal process disclosed herein, which is not possible to produce by the rolled or forged process, i.e. for example, CA40F, which contains sulfur for facilitating free machining, or high carbon austenitic stainless steels such as HK and HN, that offer exceptional mechanical properties under corrosive conditions at elevated temperatures. Both carbon and sulfur are known to cause cracks in components and thus, manufacturers often have to sacrifice the inherent advantages of these elements to prevent cracking, when producing materials by the forged or rolled process. However, through centrifugal casting, it is possible to retain these beneficial elements while mitigating the risk of cracking.

Moreover, materials such as Cobalt Chrome Alloy 6, which are inherently very hard, and others like M35-1, Cu5MCuC, and CY40, are known for their work-hardening nature. Manufacturing these materials through forging or rolling can be extremely expensive. Additionally, producing them in a hollow condition, particularly for small inner diameters (IDs), would require starting with solid forms and then boring out the ID. The process is prohibitively expensive for dimensions spanning 1.5 to 2 meters (59.055 inches to 78.740 inches) in length.

Advantageously, the refractory coating applied on the casting mold 20 not only prevents the fusion of the molten sluggish metal with the mold 20 but also enables ease of extraction of the cast tube 36. Thus, the entire process from preparing the mold to introducing the molten sluggish metal to the extraction of the cast tube (36) completes within 1 hour, after which the mold is ready to be prepared for the next campaign.

EXAMPLES

In a first exemplary embodiment, as per ASTM A890 6A CD3MWCuN (equivalent alloy UNS J93380), a first tube (A5733) was produced, having Carbon (C) 0.025%, Nickel (Ni) 8.07%, Chromium (Cr) 25.35%, Molybdenum (Mo) 3.31%, Copper (Cu) 0.58%, Tungsten (W) 0.57%, Nitrogen (N) 0.23%, Silicon (Si) 0.76%, Manganese (Mn) 0.7% and Iron (Fe) 60.405%. The tube 36 formed had an OD of 45 mm (1.772 inches), an ID of 22 mm (0.866 inches) and a length of 1500 mm (59.055 inches). Before introducing the molten sluggish material, the coating of the operative inner surface of the casting mold 20 was performed at a temperature at 212° C. (414° F.). The vfd controlled motorized coating spray nozzle speed was set at 60 Hz. The molten sluggish material was introduced at a temperature of 1598° C. (2908° F.), and pouring time taken was 14 seconds. The spinning speed of the casting mold 20 was 2400 RPM [50 rpm stepped up over 2400 rpm for every 1 mm (0.039 inches) ID decrement below 22 mm (0.866 inches)]. The tube 36 was subjected to a heat treatment at 1100° C. (2012° F.) for 2 Hrs followed by water quenching. The tube 36 thus cast by this process had an ultimate tensile strength of 699.32 Mpa, a yield strength of 590.56 Mpa and an elongation of 27%. The stainless steel ASTM A890 6A CD3MWCuN grade is suitable for valve cages, sleeves and parts where a combination of enhanced corrosion resistance and strength is required. FIG. 4A illustrates an isometric view of a thinner tube manufactured in accordance with an embodiment of the present disclosure.

In a second exemplary embodiment, as per ASTM A743 CN7M (equivalent alloy UNS N08007), a second tube (A5257) was produced, having Carbon (C) 0.054%, Nickel (Ni) 28.19%, Chromium (Ni) 19.77%, Molybdenum (Mo) 2.29%, Copper (Cu) 3.45%, Silicon (Si) 1.4%, Manganese (Mn) 1.04% and Iron (Fe) 43.806%. The tube 36 thus formed had an OD of 45 mm (1.772 inches), an ID of 21 mm (0.827 inches) and a length of 1500 mm (59.055 inches). Before introducing the molten sluggish material, the coating of the inner surface of the mold was performed at a temperature (423° F.) 217° C. The vfd controlled motorized coating spray nozzle speed was set at 60 Hz. The molten sluggish material was introduced at a temperature of (2899° F.) 1593° C., and pouring time taken was 13 sec. The spinning speed of the casting mold 20 was 2450 RPM [50 rpm stepped up over 2400 rpm for every 1 mm (0.039 inches) ID decrement below 22 mm (0.866 inches)]. The tube 36 was subjected to a heat treatment at 1120° C. (2048° F.) for 2 Hrs followed by water quenching. The tube 36 thus cast by this process had an ultimate tensile strength of 480 Mpa, a yield strength of 206.5 Mpa and an elongation of 44.6%. The stainless steel ASTM A743 CN7M grade is suitable for food processing, munitions manufacturing, rayon manufacturing, oil refining, paints, pharmaceuticals, synthetic rubber, soap, and textile and dye industries.

In a third exemplary embodiment, as per ASTM A494 CY40 (equivalent alloy UNS N06040), a third tube (A5468) was produced, having Carbon (C) 0.21%, Nickel (Ni) 74.4%, Chromium (Cr) 15.32%, Silicon (Si) 1.97%, Manganese (Mn) 1.05% and Iron (Fe) 7.05%. The tube 36 thus formed had an OD of 42 mm (1.654 inches), an ID of 16 mm (0.630 inches) and a length of 1625 mm (63.976 inches). Before introducing the molten sluggish material, the coating of inner surface of the mold 20 was performed at a temperature 226° C. (439° F.). The vfd controlled motorized coating spray nozzle speed was set at 61 Hz. The molten sluggish material was introduced at a temperature of 1585° C. (2885° F.), and pouring time taken was 14 sec. The spinning speed of the casting mold 20 was 2700 RPM [50 rpm stepped up over 2400 rpm for every 1 mm ID (0.039 inches) decrement below 22 mm (0.866 inches)]. The tube 36 thus cast was annealed at (1904° F.) 1040° C. for 2 hours, followed by water quenching, had an ultimate tensile strength of 540 Mpa, a yield strength of 251 Mpa and an elongation of 42%. The Nickel, chrome superalloy ASTM A494 CY40 grade is suitable for hot corrosives under moderately oxidizing conditions due to its high resistance to intergranular attack and stress corrosion cracking and can be used from cryogenic temperature up to 1093° C. (1999° F.).

In a fourth exemplary embodiment, as per A494 M35-1 (equivalent alloy UNS N24135), a fourth tube (A5470) was produced, having Carbon (C) 0.21%, Nickel (Ni) 67.7%, Copper (Cu) 28.2%, Silicon (Si) 0.83%, Manganese (Mn) 0.84%, & Iron (Fe) 2.22%. The tube 36 thus formed had an OD of 37 mm (1.457 inches), an ID of 17 mm (0.669 inches) and a length of 1550 mm (61.024 inches). Before introducing the molten sluggish material, the coating of the inner surface of the mold 20 was performed at a temperature of 233° C. (451° F.). The vfd controlled motorized coating spray nozzle speed was at 72 Hz. The molten sluggish material was introduced at a temperature of 1470° C. (2678° F.), and pouring time taken was 11 sec. The spinning speed of the casting mold 20 was 2650 RPM [50 rpm stepped up over 2400 rpm for every 1 mm ID (0.039 inches) decrement below 22 mm (0.866 inches)]. The tube 36 thus cast by this process had an ultimate tensile strength of 470 Mpa, a yield strength of 198 Mpa and an elongation of 27.02%. The Nickel copper superalloy ASTM A494 M35-1 grade is suitable for sea water applications and exhibits high resistance to destructive chemical action and mechanical wear.

In a fifth exemplary embodiment, as per ASTM A494 CW12MW (equivalent alloy UNS N30002), a fifth tube (A5660) was produced, having Carbon (C) 0.04%, Nickel (Ni) 53.8%, Chromium (Cr) 16.67%, Molybdenum (Mo) 16.66%, Silicon (Si) 0.84%, Manganese (Mn) 0.76%, Tungsten (W) 4.47% & Vanadium (V) 0.278% and Iron (Fe) 6.482, The tube 36 thus formed had an OD of 42 mm (1.654 inches), an ID of 18 mm (0.709 inches) and a length of 1625 mm (63.976 inches). Before introducing the molten sluggish material, the coating of the inner surface of the mold 20 was performed at a temperature of 224° C. (435° F.). The vfd controlled motorized coating spray nozzle speed was at 61 Hz. The molten sluggish material was introduced at a temperature of 1520° C. (2768° F.), and pouring time taken was 13 sec. The spinning speed of the casting mold 20 was 2750 RPM [50 rpm stepped up over 2400 rpm for every 1 mm (0.039 inches) ID decrement below 22 mm (0.866 inches)]. The tube 36 was subjected to a heat treatment at 1175° C. (2147° F.) min for 2 hrs, followed by water quenching. The tube 36 thus cast by this process had an ultimate tensile strength of 520.5 Mpa, a yield, strength of 291.7 Mpa and an elongation of 7.2%. The Nickel, Chrome, Molybdenum superalloy ASTM A494 CW12MW grade is best suitable for protection against highly corrosive chemicals such as wet chlorine, strong hypochlorite solutions, hydrochloric acid, sulfuric acid and nitric acid at moderate temperatures or under oxidizing conditions.

In a sixth exemplary embodiment, as per ASTM A494 Cu5MCuC (equivalent alloy UNS N08826), a sixth tube (A5661) was produced, having Carbon (C) 0.03%, Nickel (Ni) 42.72%, Chromium (Cr) 21.01%, Molybdenum (Mo) 3.2%, Silicon (Si) 0.68%, Manganese (Mn) 0.78%, Copper (Cu) 2.7%, Niobium (Nb) 0.83%, Iron (Fe) 28.05%. The tube 36 thus formed had an OD of 45 mm (1.772 inches), an ID of 20 mm (0.787 inches) and length of 1500 mm (59.055 inches). Before introducing the molten sluggish material, coating of the inner surface of the mold was performed at a temperature of 214° C. (417° F.). The vfd controlled motorized coating spray nozzle speed was set at 60 Hz. The molten sluggish material was introduced at a temperature of 1591° C. (2896° F.), and pouring time taken was 13 sec. The spinning speed of the casting mold 20 was 2500 RPM [50 rpm stepped up over 2400 rpm for every 1 mm (0.039 inches) ID decrement below 22 mm (0.866 inches)]. The tube 36 thus cast by this process had an ultimate tensile strength of 521.76 Mpa, a yield strength of 278.76 Mpa and an elongation of 27.08%. The tube 36 was subjected to a heat treatment at (2102° F.) 1150° C. min for 2 hrs and was stabilized 950° C. (1742° F.) for 2 hrs, followed by water quenching. The Nickel, Chrome, Molybdenum superalloy ASTM A494 Cu5MCuC grade is suitable for Phosphoric acid evaporator, pickling equipment, chemical processing vessels and piping, equipment for recovery of spent nuclear fuel.

In a seventh exemplary embodiment, as per ASTM A297 HK (equivalent alloy UNS J94224), a seventh tube (A5328) was produced, having Carbon (C) 0.33%, Nickel (Ni) 19.32%, Chromium (Cr) 25.69%, Molybdenum (Mo) 0.2%, Silicon (Si) 1.46%, Manganese (Mn) 1.44% and Iron (Fe) 51.56%. The tube 36 formed had an OD of 40 mm (1.575 inches), an ID of 15 mm (0.591 inches) and a length of 2000 mm (78.740 inches). Before introducing the molten sluggish material, coating of the inner surface of the mold 20 was performed at a temperature of 222° C. (431° F.). The vfd controlled motorized coating spray nozzle speed was set at 67 Hz. The molten sluggish material was introduced at a temperature of 1577° C. (2871° F.), and pouring time taken was 14 seconds. The spinning speed of the casting mold 20 was 2750 RPM [50 rpm stepped up over 2400 rpm for every 1 mm (0.039 inches) ID decrement below 22 mm (0.866 inches)]. The tube 36 thus cast by this process had an ultimate tensile strength of 563.1 Mpa, a yield strength of 338 Mpa and an elongation of 17.12%. The stainless steel ASTM A297 HK grade is suitable for stressed parts working up to 1100° C. such as billet skids, heat treating fixtures & furnace rollers.

In an eighth exemplary embodiment, as per ASTM A297 HN (equivalent alloy UNS J94213), an eighth tube (A5329) was produced, having Carbon (C) 0.37%, Nickel (Ni) 24.65%, Chromium (Cr) 19.12%, Molybdenum (Mo) 0.36%, Silicon (Si) 1.71%, and Manganese (Mn) 1.47% and Iron (Fe) 52.32%. The tube 36 thus formed had an OD of 37 mm (1.457 inches), an ID of 15 mm (0.591 inches) and a length of 1550 mm (61.024 inches). Before introducing the molten sluggish material, coating of the inner surface of the mold 20 was performed at a temperature of 236° C. (457° F.). The vfd controlled motorized coating spray nozzle speed was set at 72 Hz. The molten sluggish material was introduced at a temperature of 1581° C. (2878° F.), and pouring time taken was 12 sec. The spinning speed of the casting mold 20 was 2750 RPM [50 rpm stepped up over 2400 rpm for every 1 mm (0.039 inches) ID decrement below 22 mm (0.866 inches)]. The tube 36 thus cast by this process had an ultimate tensile strength of 534.2 Mpa, and an elongation of 19.74%. The stainless steel ASTM A297 HN grade is suitable for applications up to 1100° C. (2012° F.) for furnace parts such as grates & rollers, etc. with increased ductility.

In a ninth exemplary embodiment, as per ASTM A743-21 CA40F (equivalent alloy UNS J94213), a ninth tube (A5329) was produced, having maximum Carbon (C) 0.31%, Nickel (Ni) 0.7%, Chromium (Cr) 11.83%, Molybdenum (Mo) 0.04%, Silicon (Si) 1.34%, Manganese (Mn) 0.59%, Sulfur 0.24% and Iron (Fe) 84.95%. The tube 36 thus formed had an OD of 45 mm (1.772 inches), an ID of 12 mm (0.472 inches) and a length of 1550 mm (61.024 inches). Before introducing the molten sluggish material, coating of the inner surface of the mold 20 was performed at a temperature of 231° C. (448° F.). The vfd controlled motorized coating spray nozzle speed was set at 60 Hz. The molten sluggish material was introduced at a temperature of (2905° F.) 1596° C. (2905° F.), and pouring time taken was 18 sec. The spinning speed of the casting mold 20 was 2900 RPM [50 rpm stepped up over 2400 rpm for every 1 mm (0.039 inches) ID decrement below 22 mm (0.866 inches)]. The tube 36 thus cast was subjected for hardening at 980° C. (1796° F.) for 4½ hours, followed by air quenching, and tempering at (734° F.) 390° C. (734° F.) for 6 hours and then air cooled, has a hardness of 434 BHN. The stainless steel ASTM A297-21CA40F grade is suitable for valves and valve trim, pump parts for power plant and refining equipment's, sliding or wearing parts like wedges for paper mills and has greater hardness than CA15 and better machinability than CA40 due to the addition of Sulfur. FIG. 4B illustrates an isometric view of a thicker tube manufactured in accordance with an embodiment of the present disclosure.

In a tenth exemplary embodiment, as per Cobalt Chrome alloy 6 (equivalent alloy R30006), a tenth tube (A6442) was produced, having maximum Carbon (C) 1.07%, Nickel (Ni) 0.83%, Chromium (Cr) 29.14%, Molybdenum (Mo) 0.19%, Silicon (Si) 1.02%, Manganese (Mn) 0.84%, Cobalt (Co) 60.37%, Tungsten (W) 3.61% and Iron (Fe) 2.93%. The tube 36 thus formed had an OD of 70 mm (2.756 inches), an ID of 12 mm (0.472 inches) and a length of 1850 mm (72.835 inches). Before introducing the molten sluggish material, coating of the inner surface of the mold 20 was performed at a temperature of 242° C. (468° F.). The vfd controlled motorized coating spray nozzle speed was set at 39 Hz. The molten sluggish material was introduced at a temperature of 1497° C. (2727° F.), and pouring time taken was 27 sec. The spinning speed of the casting mold 20 was 2900 RPM [50 rpm stepped up over 2400 rpm for every 1 mm ID (0.039 inches) decrement below 22 mm (0.866 inches)]. The tube 36 thus formed had a hardness of 42 HRC. The Cobalt Chrome Superalloy 6 is suitable for wear plates and bars, bushes & sleeves for operation in hot & corrosive atmosphere, where lubrication is impossible.

In an eleventh exemplary embodiment, as per ASTM A351 CF3M (equivalent alloy UNS J92800), an eleventh tube (A6442) was produced, having maximum Carbon (C) 0.028%, Nickel (Ni) 9.43%, Chromium (Cr) 17.8%, Molybdenum (Mo) 2.24%, Silicon (Si) 1.2%, Manganese (Mn) 0.75% and Iron (Fe) of 68.552. The tube 36 thus formed had an OD of 99 mm (3.897 inches), ID of 22 mm (0.866 inches) and length of 1500 mm (59.055 inches). Before introducing the molten sluggish material, the coating of inner surface of the mold 20 was performed at a temperature of 240° C. (464° F.). The vfd controlled motorized coating spray nozzle speed was set at 27 Hz. The molten sluggish material was introduced at a temperature of 1586° C. (2887° F.), and pouring time taken was 39 sec. The spinning speed of the casting mold 20 was 2400 RPM [50 rpm stepped up over 2400 rpm for every 1 mm (0.039 inches) ID decrement below 22 mm (0.866 inches)]. The tube 36 thus cast was subjected to hardening at 1040° C. (1904° F.) for 2 hours, followed by water quenching. The tube 36 thus cast by this process had an ultimate tensile strength of 525.82 Mpa, a yield strength of 327.81 Mpa and an elongation of 40.38%. The stainless-steel ASTM A351 CF3M grade is suitable for pumps, valves, fittings, etc. in reducing acids, paper mill equipment, chemical process industries, sea water service, etc.

The foregoing description of the embodiments has been provided for the purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

Technical Advances and Economical Significance

The present disclosure described herein above has several technical advantages including, but not limited to, the realization of an apparatus to cast tubes of sluggish material and a process thereof, that:

casts tubes of smaller ID's and OD's and length;

minimizes gas entrapment in the cast tube while casting;

minimizes non-metallic inclusions in the cast tube by filtering the same to the ID of the cast tube;

the apparatus requires considerably less floor space;

avoids the formation of surface cracks on the cast tube;

is versatile and has flexibility to cast different grades of tubes;

allows for the addition of alloying elements as required for different applications, which otherwise would not be possible by rolling or forging due to equipment and/or material constraints; and allows desirable additions of carbon as per the ASTM standards for cast heat resistant stainless steel tube, so as to achieve the desired mechanical properties.

reduces labor requirements compared to conventional sand or investment casting processes;

does not rely on sand for mold creation, thereby eliminating defects such as sand inclusions in the final product;

is capable of producing tubes that can withstand high pressures, specifically those exceeding 4.5 bars, to ensure suitability for leak-proof operations;

minimizes defects, particularly in materials susceptible to cracking;

can be suitable for hard materials like Cobalt Chrome Alloy 6 and work hardening materials such as M35-1, Cu5MCuC, and CY40, without incurring prohibitive expenses.

The foregoing description of the specific embodiments so fully reveals the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

What is claimed is:

1. An apparatus (100) to cast a tube (36) of sluggish material, said apparatus (100) comprising:

at least one cylindrical casting mold (20), configured with a first operative apertured end (20*a*) and a second operative apertured end (20*b*), wherein the at least one cylindrical casting mold (20) is configured with at least two guide path grooves (78) around a circumference of the at least one cylindrical casting mold (20);

a heating means (42), configured to heat the at least one cylindrical casting mold (20), said heating means (42) configured above an operative top of the at least one cylindrical casting mold (20);

at least one set of rollers (32, 34) comprising a driving roller (34) and an idler roller (32), each of the rollers of the at least one set of rollers (32, 34) configured to abut an operative outer surface of the at least one cylindrical casting mold (20) in the at least two guide path grooves (78), and further configured to spin the at least one cylindrical casting mold (20) in an operative configuration of the apparatus (100);

a driving member (38), configured to drive the at least one set of rollers (32, 34) at desired speeds wherein the driving member (38) is a motor and drive control unit, configured to spin the driving roller (34) and in-turn spin the at least one cylindrical casting mold (20) and the idler roller (32);

at least one tank (10), configured to store a refractory coating material therein;

a spray nozzle (40), configured to be connected to the at least one tank (10), and further configured to introduce the refractory coating material through the first operative apertured end (20*a*) of the at least one cylindrical casting mold (20) and traverse a length of the at least one cylindrical casting mold (20) towards a second apertured end (20*b*), wherein the at least one cylindrical casting mold (20) is spinning at a first speed in the range of 400 RPM-600 RPM to uniformly coat an operative inner surface of the at least one cylindrical casting mold (20) with a coat of a predetermined coating thickness in a first operative configuration of the apparatus (100);

two pre coated end plates (72), each of the pre coated end plates (72) configured to be attached at each operative end of the at least one cylindrical casting mold (20) in a second operative configuration of the apparatus (100), each of the pre coated end plates (72) defined by a circular-disc shaped plate, and with an outer diameter (OD) of each of the pre coated end plates (72) being matched to fit at a groove (80) at an inner diameter (ID) of the at least one cylindrical casting mold (20), and each of the pre coated end plates (72) having a through-hole thereon;

gaskets (82) placed between each of the pre coated end plates (72) and the groove (80) configured at both operative aperture ends (20*a*, 20*b*) of the at least one cylindrical casting mold (20);

at least one tundish (50), configured to receive a molten sluggish material (60) from a ladle and change a direction of flow of the molten sluggish material (60) in a desired direction;

a reinforced snout (70), configured to be connected to the at least one tundish (50), the reinforced snout (70) configured to introduce the molten sluggish material (60) in to the operative inner surface of the at least one cylindrical casting mold (20) through the second operative apertured end (20*b*), wherein the at least one cylindrical casting mold (20) is spun at a second speed in the range of 2400 RPM-3000 RPM in the second operative configuration of the apparatus (100), wherein the reinforced snout (70) is configured to be located axially flush with the second operative aperture end (20*b*) while introducing the molten sluggish material (60) in to the at least one cylindrical casting mold (20), wherein an opening at a tundish end of the reinforced snout (70) has diameter in the range of 10 mm to 10.5 mm (0.394 inches to 0.413 inches) and has an opening at a mold end of the reinforced snout (70) in the range of 4.5 to 5.5 mm (0.177 inches to 0.217 inches), the opening at the mold end of the reinforced snout (70) being spaced apart from the second operative apertured end (20*b*) of the pre coated end plates (72) by a distance of 7 to 10 mm (0.276 inches to 0.394 inches); and cooling means (44), configured to cool the at least one cylindrical casting mold (20); the cooling means (44) configured below an operative bottom of the at least one cylindrical casting mold (20), the cooling means (44) selected from an air-based cooling unit or a water-based cooling unit;

wherein, the at least one set of rollers (32, 34) is configured to spin the at least one cylindrical casting mold (20) at a first predetermined speed in the first operative configuration and at a second predetermined speed in the second operative configuration to cast the tube (36) of a predetermined inner diameter (ID), a predetermined outer diameter (OD) and a predetermined length.

2. The apparatus (100) according to claim 1, wherein the heating means (42) is a gas burner comprising of several gas nozzles that are configured to heat the at least one cylindrical casting mold (20) to a temperature in the range of 200° C.-250° C. 200° C.-250° C. (392° F.-482° F.) in the first operative configuration of the apparatus (100).

3. The apparatus (100) according to claim 1, wherein the apparatus (100) is configured to cast the tube (36) of the predetermined outer diameter (OD) between 36 mm-100 mm (1.417 inches-3.937 inches), the inner diameter (ID) between 12 mm-23 mm (0.472 inches-0.906 inches), and the length in the range of 150 mm-2000 mm (59.055 inches-78.740 inches).

4. The apparatus (100) according to claim 1, wherein said apparatus is configured to cast the tube (36) of the predetermined outer diameter (OD) in the range of 36 mm-45 mm, (1.417 inches-1.772 inches), the predetermined inner diameter (ID) in the range of 12 mm-22 mm (0.472 inches-0.866 inches) and the predetermined length greater than 1500 mm (59.055 inches) and less than 2000 mm (78.740 inches).

5. The apparatus (100) according to claim 1, wherein the apparatus is configured to cast the tube (36) of the predetermined outer diameter (OD) of 70 mm (2.756 inches), the predetermined inner diameter (ID) of 12 mm (0.472 inches) and the predetermined length greater than 1500 mm (59.055 inches) and less than 2000 mm (78.740 inches).

6. The apparatus (100) according to claim 1, wherein the at least one cylindrical casting mold (20) is of 30CrMo Steel with a run-out ranging between 0.002 mm-0.1 mm (0.0001 inches-0.004 inches).

7. The apparatus (100) according to claim 1, wherein the reinforced snout (70) is configured with stainless steel needles; and wherein the reinforced snout (70) is made of refractory material.

8. A process for casting a tube (36) of sluggish material using the apparatus (100) according to claim 1, said process comprising the following steps:

arranging the at least one cylindrical casting mold (20) on the at least one set of rollers (32, 34), the at least one cylindrical casting mold (20) having the first operative apertured end (20*a*) and the second operative apertured end (20*b*) at extremities of the at least one cylindrical casting mold (20);

driving the at least one set of rollers (32, 34) to spin the at least one cylindrical casting mold (20) at a predetermined speed using the driving member (38);

heating the at least one cylindrical casting mold (20) for a predetermined temperature between 200° C.-250° C. (392° F.-482° F.) by the heating means (42);

spinning the at least one cylindrical casting mold (20) at the first speed in the range of 400 RPM-600 RPM;

introducing the refractory coating material by means of the spray nozzle (40) in the operative inner surface of the at least one cylindrical casting mold (20) through the first operative apertured end (20*a*), the refractory coating material being a slurry formed by mixing silica flour paste with water;

traversing the spray nozzle (40) forwards from the first operative aperture end (20*a*) towards the second operative aperture end (20*b*) to uniformly coat the operative inner surface of the at least one cylindrical casting mold (20) with a coating of a predetermined thickness;

stopping the at least one set of rollers (32, 34) to stop the spinning of the at least one cylindrical casting mold (20) to enable attachment of the pre coated end plates (72);

attaching the pre coated end plates (72) at each operative end of the at least one cylindrical casting mold (20) shielded by the gaskets (82);

arranging the at least one tundish (50) at the second operative apertured end;

connecting the reinforced snout (70) to the at least one tundish (50);

melting sluggish material in a furnace at a temperature in the range of 1400° C.-1600° C. (2552° F.-2912° F.) for forming a molten sluggish material (60) in a bath;

adding at least one fluidity enhancer to the molten sluggish material (60) in the bath;

spinning the at least one cylindrical casting mold (20) at the second speed in the range of 2400 RPM-3000 RPM;

tapping the molten sluggish material (60) from the bath into the ladle;

transporting the ladle to the at least one tundish (50) by using an overhead crane;

introducing the molten sluggish material (60) in the operative inner surface of the at least one cylindrical casting mold (20) through the second operative apertured end, via the at least one tundish (50) and the reinforced snout (70) to centrifugally uniformly disperse the molten sluggish material (60) along the length of the inner surface of the at least one cylindrical casting mold (20);

cooling the at least one cylindrical casting mold (20) to a temperature in the range of 200° C.-250° C. (392° F.-482° F.) by means of the cooling means (44) to solidify the molten sluggish material (60) to form a cast of the tube (36) of the predetermined inner diameter (ID), the predetermined outer diameter (OD) and the predetermined length;

stopping the spinning of the at least one cylindrical casting mold (20);

loosening and removing the pre coated end plates (72) from the operative ends of the at least one cylindrical casting mold (20); and taking out the cast tube (36) from the at least one cylindrical casting mold (20).

9. The process according to claim 8, further comprises the following steps:

adding at least one deoxidizing element to the molten sluggish material (60) in the bath in the furnace;

shielding the molten sluggish material (60) with a protective synthetic slag; and cleaning-out the slag before introducing the molten sluggish material (60) into the operative inner surface of the at least one cylindrical casting mold (20).

10. The process according to claim 9, wherein the at least one deoxidizing element is at least one selected from a group consisting of ferro-titanium, ferro-boron, lanthanum, having ferro-titanium in the range of 0.1%-0.5% of the mass of the molten sluggish material (60), ferro boron in the range of 0.1%-2.0% of the mass of the molten sluggish material (60), and lanthanum in the range of 0.02%-0.1% of the mass of the molten sluggish material (60).

11. The process according to claim 8, wherein the at least one fluidity enhancer is at least one selected from a group consisting of Carbon in the range of 0.015%-1.3% of the mass of the molten sluggish material (60) and silicon in the range of 0.25%-2.5% of the mass of molten sluggish material (60).

12. The process according to claim 8, wherein the step of introducing the molten sluggish material (60) in the at least one cylindrical casting mold (20) is performed at a pouring temperature in the range of 1400° C.-1600° C. (2552° F.-2912° F.).

13. The process according to claim 8, wherein the step of selecting the rpm at which to spin the at least one cylindrical casting mold (20) depends upon the volume of the molten sluggish material (60) utilized in the process.

14. The process according to claim 8, wherein in the step of introducing the molten sluggish material (60) in the operative inner surface of the at least one cylindrical casting mold (20), wherein the reinforced snout (70) is arranged in a manner that the opening of the snout (72) is positioned to be axially flush with the aperture end (20*b*) of the corresponding pre coated end plates (72) and spaced apart from it by a distance of 7 mm-10 mm (0.276 inches-0.394 inches).

15. The process according to claim 8, wherein the process is used for casting the tube (36) having the predetermined outer diameter (OD) less than 100 mm (3.937 inches), the predetermined inner diameter (ID) less than 24 mm (0.945 inches), and the predetermined length up to 2000 mm (78.740 inches).

16. The process according to claim 8, wherein the molten sluggish material (60) is selected from a group consisting of at least one from stainless steel, superalloys with either Nickel, Chromium, Molybdenum, Copper and a combination thereof.

17. The process according to claim 8, wherein the coating thickness on the operative inner surface of the at least one cylindrical casting mold (20) is in the range of 0.5 mm to 1.5 mm (0.020 inches to 0.059 inches).

* * * * *